US011608700B2

(12) United States Patent
Wang

(10) Patent No.: US 11,608,700 B2
(45) Date of Patent: Mar. 21, 2023

(54) METHODS AND SYSTEMS FOR ANCHORING A PLUG IN A WELLBORE

(71) Applicant: Sharp-Rock Technologies, Inc., Cypress, TX (US)

(72) Inventor: Hong Wang, Cypress, TX (US)

(73) Assignee: SHARP-ROCK TECHNOLOGIES, INC., Cypress, TX (US)

( * ) Notice: Subject to any disclaimer, the term of this patent is extended or adjusted under 35 U.S.C. 154(b) by 330 days.

(21) Appl. No.: 17/065,236

(22) Filed: Oct. 7, 2020

(65) Prior Publication Data

US 2021/0131211 A1 May 6, 2021

Related U.S. Application Data

(60) Provisional application No. 63/057,356, filed on Jul. 28, 2020, provisional application No. 62/982,958, filed on Feb. 28, 2020, provisional application No. 62/982,950, filed on Feb. 28, 2020, provisional application No. 62/930,256, filed on Nov. 4, 2019, provisional application No. 62/928,870, filed on Oct. 31, 2019.

(51) Int. Cl.

| | |
|---|---|
| ***E21B 23/01*** | (2006.01) |
| ***E21B 23/06*** | (2006.01) |
| ***E21B 33/128*** | (2006.01) |

(52) U.S. Cl.

CPC ..... *E21B 23/06* (2013.01); *E21B 23/01* (2013.01); *E21B 33/128* (2013.01)

(58) Field of Classification Search

CPC ..... E21B 23/01; E21B 33/128; E21B 23/06

See application file for complete search history.

(56) References Cited

U.S. PATENT DOCUMENTS

| | | | | |
|---|---|---|---|---|
| 2016/0002998 | A1* | 1/2016 | Wang | E21B 33/1208 166/382 |
| 2016/0145965 | A1* | 5/2016 | Zhao | E21B 33/1208 166/387 |
| 2020/0148945 | A1* | 5/2020 | Narhi | E21B 43/08 |

* cited by examiner

*Primary Examiner* — Cathleen R Hutchins

(74) *Attorney, Agent, or Firm* — Pierson Intellectual Property LLC

(57) ABSTRACT

Forming an anchored plug in a wellbore utilizing grain-like solids to transfer an axial force to a radial force to dissipate the axial force within an effective screening length.

18 Claims, 6 Drawing Sheets

METHODS AND SYSTEMS FOR ANCHORING A PLUG IN A WELLBORE

BACKGROUND INFORMATION

Field of the Disclosure

Examples of the present disclosure relate to systems and methods for anchoring a plug in a wellbore. More specifically, embodiments are directed towards utilizing grain-like solids to transfer an axial force to a radial force to dissipate the axial force within an effective screening length.

Background

When drilling a well for hydrocarbon, it is necessary to provide zonal isolation between areas above and below a plug. The plug may be used to stop communication, pressure, and/or fluids between the multiple zones of the well. In some applications, plugs are utilized to limit or prevent fluid from flowing from a deeper area of a well towards a surface of the well, which could contaminate the surrounding environment.

To be effective, the plugs must be anchored in place and then seal a wellbore to limit the communications across the plugs. To remain anchored in place, the plugs have to be able to resist forces, pressures, etc. applied against the plugs that would result in slippage. Conventional plugs are anchored downhole by pumping cement slurry through tubing to a location and then let the cement set in place over time to create bonding to the wellbore wall. However, it is expensive to pump cement downhole through tubing. The brittle cement plugs may deteriorate overtime and fail. Mechanical packers are conventionally used for zonal isolation downhole. Yet, packers are required to be mechanically or hydraulically set. As such, packers typically are only used to temporally seal a wellbore.

Typically, a high pressure zone is from the bottom of a wellbore. To isolate such a zone, a plug has to be placed above the zone and is able to resist the force from the high pressure acting on the bottom of the plug to move the plug upward and cause the plug to fail.

Accordingly, needs exist for systems and methods for efficiently and effectively anchoring a plug downhole, wherein the anchor utilizes grain-like solids to divert an axial force into a radial force while maintaining a length that is greater than an effective screening length.

SUMMARY

Examples of the present disclosure relate to systems and methods for anchoring a plug downhole utilizing grain like solids to translate a first force, such an axial force, which may cause the slippage of the plug to a second force, such as a radial force or lateral force, within an effective screening length. The second force then may induce additional friction to the plug of the grain-like solids on the wellbore wall resisting the slippage to anchor the plug. The applied first force, due to the generated shearing tendency within the plug, may rapidly diminish or dissipate over a short distance, which may limit the first force being applied to other elements of the plug to move the plug. By limiting the first force further applied to other elements of the plug and generating enough friction force, the plug may remain in place permanently. In other words, when the plug is long enough, the friction induced may not be overcome by the first force applied to move the plug and the plug may be therefore anchored in place.

Embodiments to anchor a plug downhole may include multiple steps. A first step may be to form a support structure such as a cement plug, a bridge plug or a mechanical packer if the grain like solids are not to be placed right off the bottom of a wellbore. So the bottom may be a support structure. A second step may be to install a packing of grain-like solids to serve as a plug anchor. To install the grain-like solids in the wellbore, they, in carrying fluid, may be pumped to be placed within the wellbore and then let them sink to accumulate to form a packing. Optionally, the grain-like solids may be simply dumped into a wellbore to let them sink to a location. Furthermore, in order to limit pressure communication through the packing of the grain-like solids from the higher-pressure side of the plug, a particle layer that may be formed by a layer of lower permeability solids may be positioned adjacent to the packing of the grain-like solids and on the higher pressure side of the plug. The second force generated by the grain-like solids may not move the plug of the grain-like solids in the radial direction, effectively anchoring the plug of the grain-like solids in place.

Optionally, embodiments of such a plug may be configured to be anchored within a wellbore, wherein the plug may further comprise an environmental layer.

The environmental layer may be formed of clay, mud, etc., which may be pumped downhole below the particle layer. Mud is a dispersed form of clay in a liquid. The environmental layer may be formed by the flow of fluid from the high-pressure end of the plug towards the low-pressure end of the plug. Utilizing the environmental layer, a tight seal may be formed on the high-pressure side of the plug. The environmental layer may become highly viscous after absorbed water and cannot pass through the packing of the grain-like solids. In embodiments, the environmental layer may include clay, dispersed clay, mud, compressed clay pieces, chunks or granules that may be pumped down in a carrying fluid or dumped into a wellbore directly. The clay comprises bentonite, smectite and/or sepiolite. The clay comprises any clay, organoclay or surfactant coated clay. Clay or compressed clay may further be coated with polymer to delay its hydration process so that it may be mixed in fluid and pumped to place before substantially hydrated.

Embodiments of a plug may be configured to be anchored within a wellbore, wherein the plug may comprise a packing, support structure, particle layer, and environmental layer.

Optionally, embodiments of a plug may be configured to be anchored within a wellbore, wherein the plug may include a particle layer and environmental layer blended together. Optionally, embodiments of a plug may be configured to be anchored within a wellbore, wherein the plug may include a grain-like solids layer, particle layer and environmental layer all blended together.

The anchoring packing may be grain-like solids, such as grains, particulates, sand, beads, etc. that range in sizing from several microns to 1 inch, which may be preferably approximately 500 microns to 2500 microns in length or diameter wherein each of the grain-like solids may be the same size or different sizes with uniform or non-uniform density. The packing may be formed by grain-like solids in various shapes, such as a random shape, spheres, rings, cubes, etc. The packing and the grain-like solids may be referred to hereinafter, collectively and individually as "stress relieving elements." The stress relieving elements may be porous or form porous layers to allow fluid to communicate through the stress relieving elements or portions of the stress relieving elements. In embodiments, the stress relieving elements may be solid and non-pliable materials, pliable materials, or a combination, wherein the stress relieving elements, or portions of the stress relieving elements, may be linked together via strings, chains, etc. to form a three-dimensional interconnected network. Grain-like solids may be made of sand, gravel, calcium carbonate, dolomite, granite, limestone, rubber, steel, stainless steel, tungsten carbide, barite, walnut hull, ceramic, concrete, lime, clay, fired clay, porous solids, etc., which may be rubber coated to form a seal when squeezed.

Similarly, if a hollow cavity is not of a shape like a circular wellbore, the same still holds. In general, the stress relieving elements in a hollow cavity may dissipate a force along one of its longer dimensions acting on the elements over a certain distance in the elements by diverting the force to a direction along a shorter dimension so that the stress relieving elements may not be pushed away by the force. When multiple sections of stress relieving elements are placed, optionally, one section may be a support structure for another next to it.

Additionally, a surface of the stress relieving elements may be rough, sharp, not smooth or uniform, which may assist in creating friction between the elements and the wall of a wellbore or casing. In embodiments, the stress relieving elements may be pre-packaged, before they are deposited into the wellbore or a hollow cavity, within at least one bag, wrap, enclosure, rubber packing and then positioned within the wellbore or hollow cavity.

In embodiments, a length of the stress relieving elements may be longer than an effective screening length. The effective screening length may be based upon the geometry of a cross sectional area, such as the radius of a wellbore, a packing of the stress relieving elements, a friction factor along the surface of the wall of such as a wellbore, and a coefficient (Janssen's coefficient) that is independent of the geometry of the cross sectional area, radius or friction factor. The effective screening length may be long enough to radially disperse the axial force to limit the axial force through the plug, relying on the friction along the inner wall of a casing to anchor the plug in place.

The support structure may be positioned on a lower side of the plug, which may be positioned between the stress reliving elements and the higher-pressure side of the plug. The support structure may be large objects, such as bricks, rocks or other objects with lengths substantially larger than that of the stress relieving elements. A support structure may be necessary when the stress relieving elements are not prepackaged in such as a bag or rubber packing. A highly viscous clay plug such as bentonite plug when long enough may be used as a support structure.

The particle layer may be positioned between the support structure and the stress relieving elements, and may be formed of finer sealing particles. Some of the elements of the particle layer may be large enough so they will not pass through the stress relieving elements, but small enough to form a filter plug or seal at the high-pressure side of the plug.

In one embodiment, stress relieving elements are mixed into fluid of 0.3% xanthan in water. The stress relieving elements carried by the fluid is then pumped into a wellbore to a location. In another embodiment, the carrying fluid is linear polyacrylamide polymer in water. These fluids may allow the stress relieving elements to settle due to gravity to accumulate onto a support structure and form a packing over time since the fluid may have low or no gel strength and viscosity may be deteriorating over time. In one embodiment, the stress relieving elements and finer sealing particles in fluid are pumped ahead of cement slurry into the annulus between a naked wellbore and a set of steel casing during a primary cementing job in a hydrocarbon well drilling process.

In embodiments, screen-like objects may be applied in the path of the flow of the carrying fluid to screen out the grain-like solids to form a packing.

A radial force may be gravity in a vertical wellbore. A radial force may also be typically the force applied to the stress relieving elements to cause a plug to move or fail when there is no enough anchoring effect for the plug. An example embodiment of a radial force may be from increasing pressure below a plug caused by fluid pressure from an oil bearing zone.

These, and other, aspects of the invention will be better appreciated and understood when considered in conjunction with the following description and the accompanying drawings. The following description, while indicating various embodiments of the invention and numerous specific details thereof, is given by way of illustration and not of limitation. Many substitutions, modifications, additions or rearrangements may be made within the scope of the invention, and the invention includes all such substitutions, modifications, additions or rearrangements.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

Figure 1:
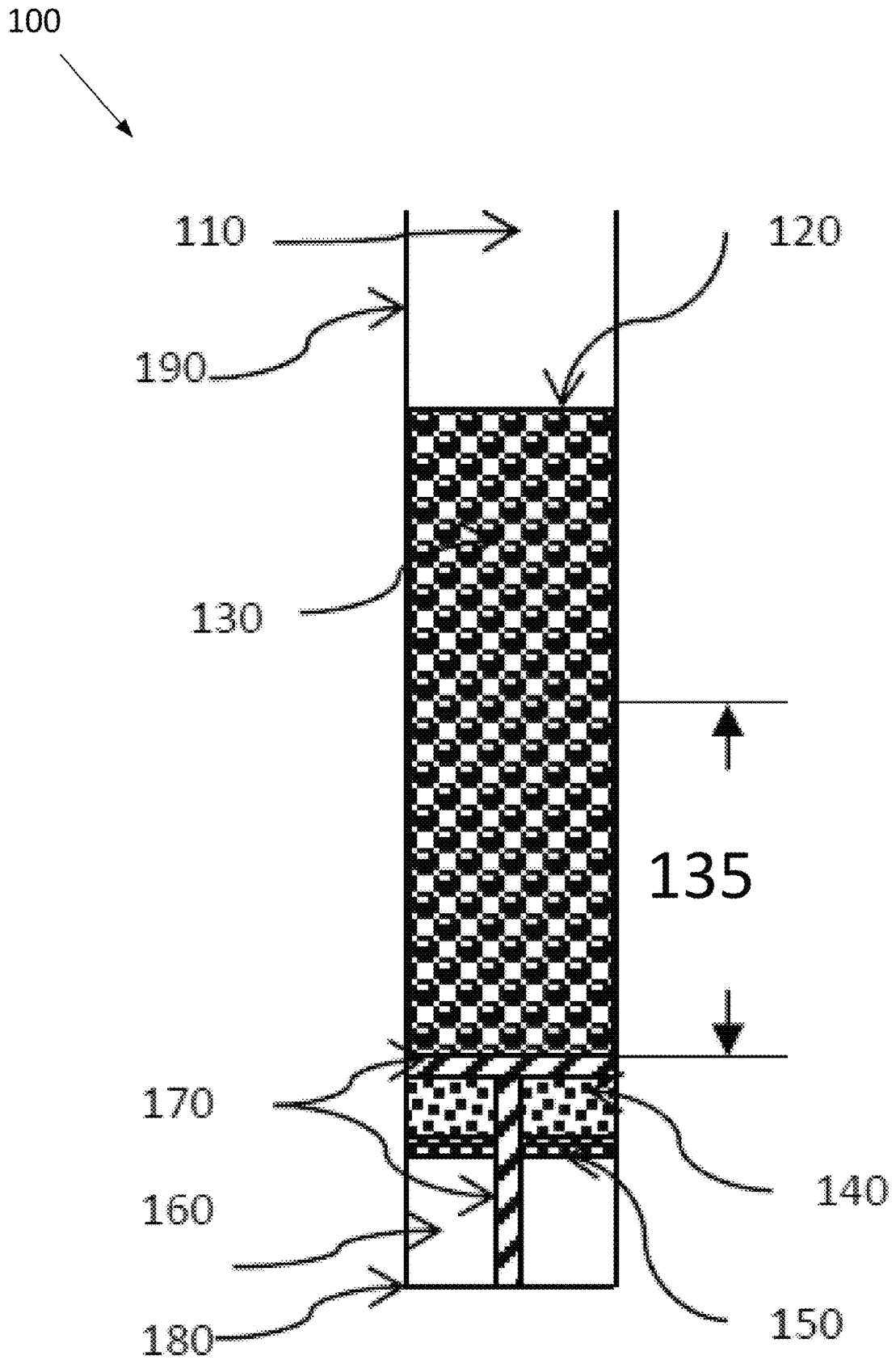
FIG. 1 depicts an anchor system configured to anchor a plug in a hollow cavity, according to an embodiment.

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help improve understanding of various embodiments of the present disclosure. Also, common but well-understood elements that are useful or necessary in a commercially feasible embodiment are often not depicted in order to facilitate a less obstructed view of these various embodiments of the present disclosure.

DETAILED DESCRIPTION

In the following description, numerous specific details are set forth in order to provide a thorough understanding of the present embodiments. It will be apparent, however, to one having ordinary skill in the art, that the specific detail need not be employed to practice the present embodiments. In other instances, well-known materials or methods have not been described in detail in order to avoid obscuring the present embodiments.

FIG. 1 depicts an anchor system 100 configured to anchor a plug in a wellbore 110, pipe, tool, annulus, or any other type of hollow cavity, according to an embodiment. System 100 may include casing 190, stress relieving elements 130, support structure 170, particle layer 140, and environmental layer 150. Embodiments of anchor system 100 may be configured to translate and dissipate an axial force applied between a higher pressure end 160 and a lower pressure end 120 (or vice versa) to a radial force application against casing 190 over an effective screening length 135. The radial force applied to casing 190 may be configured to anchor system 100 in place even when a pressure differential between higher pressure end 160 and lower pressure end 120 is large.

Casing 190 may be any type of pipe used to line the inside of a drilled hole. In further embodiments, casing 190 may be any type of hollow conduit configured to communicate fluid, gas, liquid, solids, etc. between a proximal end and distal end of casing 190. For example, in other embodiments, casing 190 may be an inner diameter of a downhole tool, plumbing pipes, sewer lines, etc., which may be comprised of various materials. These materials may include metals, wood, ceramic, PVC, clay, plastics, etc., which may or may not be permeable.

Stress relieving elements 130 may be grain-like solids, such as grains, sand, beads, etc. that range in sizing from several microns to 1 inch, wherein each of the grain-like solids may be the same size or different sizes with uniform or non-uniform density. Stress relieving elements 130 may preferably be approximately 500 microns to 2500 microns in length or diameter. Stress relieving elements 130 may be bundled together in a packing, wherein individual stress relieving elements 130 or modules of stress relieving elements 130 may be linked together via strings, chains, or other forms of coupling mechanisms to form a three-dimensional interconnected network of stress relieving elements 130. Furthermore, stress relieving elements 130 or portions of the stress relieving elements may be porous or form a porous layer to allow fluid to communicate through the stress relieving elements or portions of stress relieving elements 130. Additionally, a surface of stress relieving elements 130 may be rough, sharp, not smooth or uniform, which may assist in creating friction between stress relieving elements 130 and a wall of wellbores, tools, or casing. Responsive to creating a pressure differential between higher pressure side 160 and lower pressure side 120, a first force, such as an axial force, applied to stress relieving elements 130 may cause stress relieving elements 130 to compress and apply a second force, such as a lateral or radial force, against the inner diameter of casing 190 inducing friction against casing 190. This induced friction may anchor the plug in place. In embodiments, the second force may be positioned at an angle with respect to the first force.

In embodiments, stress relieving elements 130 may be pre-packaged, before they are deposited into the wellbore, within at least one bag, wrap, enclosure, and then positioned within the wellbore. In embodiments, stress relieving elements 130 may be positioned within the wellbore 110 by being dumped, poured, etc. within the wellbore 110, and then sink to the bottom to accumulate together downhole to form a packing. The packing may also be mixed with a carrying fluid, and then pumped downhole through tubing. In embodiments, the packing may be tightened before being positioned within the wellbore by initially positioned the stress relieving elements 130 within a permeable or impermeable barrier, such as at least one container, bag, fabric, screen, rubber housing, etc. The container or multiple containers may then be squeezed to hold the packing of stress relieving elements 130 in place.

A length of stress relieving elements 130 positioned downhole may be at least as long as an effective screening length 135. Effective screening length 135 may be a length that is long enough to translate an axial force applied to stress relieving elements 130 to a radial force such that the other elements within system 100 may not be impacted by the pressure differentials between higher pressure side 160 and lower pressure side 120. Accordingly, an element above and/or below stress relieving elements 130 may not be eroded, bent, etc. due to stress relieving elements dissipating the axial force. Details about the effective screening length $\lambda$ can be found in this article: "Overshoot Effect in the Janssen Granular Column: A Crucial Test for Granular Mechanics" by G. Ovarlez, et al. published in Physical Review E 67(6 Pt 1): 060302, July 2003. In embodiments, the effective sealing length $\lambda$ may be based on equation (1) shown below.

$$\lambda=R/(2K\mu_s) \tag{1}$$

The effective screening length 135 may be equal to the radius (R) of casing 190 divided by two times the Janssen's coefficient (K) multiplied by the friction factor ($\mu_s$) along the inner diameter of casing 190. In other embodiments, the effective screening length may be based on not the radius of casing 190, but the width (W) of a rectangle cross sectional shape of a long hollow cavity as shown below in equation (2).

$$\lambda=(W/2)/(2K\mu_s) \tag{2}$$

As such, the effective screening length 135 may be substantially based on the radius (or an equivalent dimension of a cross sectional area) of the casing 190 and the friction factor of the inner wall of casing 190, wherein based on the diameters of standard wellbores the effective screening length 135 of most anchor systems 100 may be less than twenty feet. In embodiments, the friction factors associated with the inner diameter of a given casing 190 may be determined through various lab tests. However, the length of system 100 may be determined by directly measuring through testing anchor system 100 in a similar bore, pipe, etc. with similar stress relieving elements 130, wherein in embodiments a length of the stress relieving elements 130 may be multiple times the effective screening length 135. From equations (1) and (2) presented above, it is known that increasing the roughness, irregularities, surface areas, etc. of the inner diameter of casing 190 may greatly increase the friction factors. When increasing the friction factors of the inner diameter of casing 190, the effective screening length 135 may correspondingly decrease. In extreme conditions, profiles on the inner diameter of casing 190 may be created so that the friction may be maximized, and the effective screening length minimized. The inner profiles may be formed with various shapes, square, triangle, round, irregular, etc. These profiles may further comprise stoppers that are to help to contain or hold the stress reliving elements in place.

Support structure 170 may be a larger volume object than that of stress relieving elements 130. Support structure 170 may be configured to be positioned on one side of the stress relieving elements. Support structure 170 is positioned below the stress relieving elements so that the elements may not fall due to gravity or move due to such as vibration, etc. and in this embodiment it is the higher pressure side160 of the wellbore, which may be between stress relieving elements 130 and a distal end 180 of the wellbore.

Particle layer 140 may be positioned between the support structure and a distal end of the plug, and may be formed of finer sealing particles. Some of the elements of the particle layer 140 may be large enough so they will not pass through stress relieving elements 130, but small enough to form a filter, seal, or plug at higher pressure side 160 of the system 100.

Environmental layer 150 may be formed of clay, mud, etc., which may be pumped downhole below particle layer 140. Environmental layer 130 may be formed by the flow of fluid from the high-pressure end 160 of the plug towards the low-pressure end 120 of the plug. Utilizing environmental layer 130, a plug may be formed on the high-pressure side 160 of anchor system 100. In embodiments, the environmental layer 150 and the particle layer 140 may be configured to form a seal and/or layers of low permeability adjacent to the stress relieving elements 130 on the higher-pressure end 160 of the anchor system 100.

Figure 2:
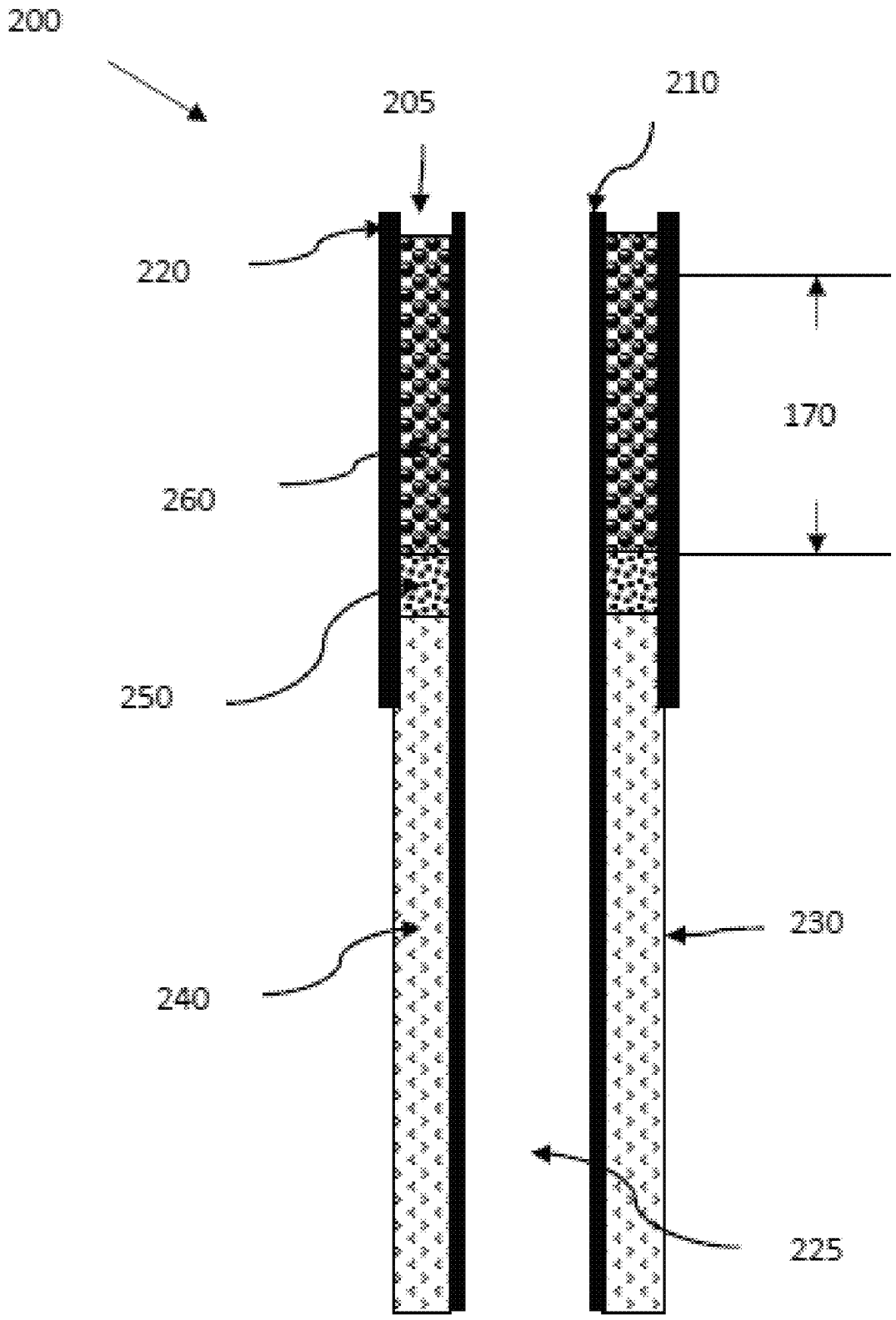
FIG. 2 depicts an anchor system configured to anchor a plug in a wellbore, according to an embodiment.

FIG. 2 depicts an anchor system 200 configured to anchor a plug in an annulus 205, according to an embodiment. Elements depicted in anchor system 200 may be described above, and for the sake of brevity a further description of these elements may be omitted. In embodiments, anchor system 200 may include first casing 210 with a smaller diameter and a second casing 220 with a larger diameter. Second casing 220 may be positioned right above a naked bore 230 of a similar diameter, together with bore 230 forming a wellbore 225. The second casing 220 may be bonded by cement to a bore wall protected by the second casing. First casing 210 may be positioned within wellbore 225, which may be within a subterranean formation. Between the outer wall of first casing 210 and the wellbore 225, an annulus 205 is formed. In the annulus 205, adjacent to the outer diameter of casing 210 at a bottom of annulus 205 may be cement 240, wherein a proximal end of cement 240 may be aligned, and positioned between, with both first casing 210 and second casing 220.

Above the proximal end of cement 240 may be positioned a sealing barrier 250, which may be formed of particle layers and/or an environmental layer, as described above. Positioned above a proximal end of sealing barrier 250 may be stress relieving elements 260, which have a length that is at least as long as an effective screening length 170. In embodiments, the elements within the sealing barrier 250 and the stress relieving elements 260 may be first mixed with carrying fluids, and then pumped down at different times within casing 210. Cement 240 may then be pumped through first casing 210, and continued circulation may move stress relieving elements 260, sealing barrier 250, and cement 240 around a distal end of first casing 210 and back up hole into annulus 205. Based on the relative positions and/or densities of the elements within sealing barrier 250 and stress relieving elements 260, stress relieving elements 260 may naturally settle and accumulate above sealing barrier 250. Cement 240 may be the support structure for the anchoring system 200.

Figure 3:
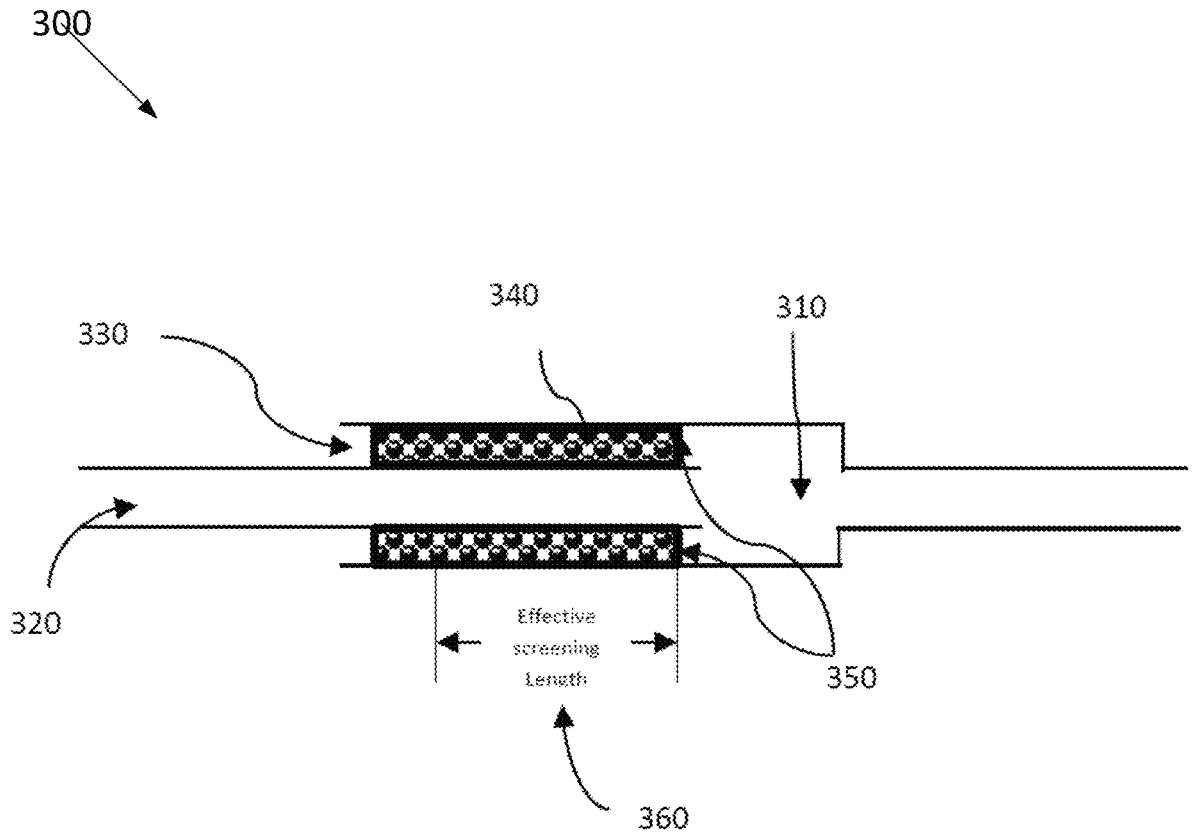
FIG. 3 depicts an anchoring system configured to anchor a plug in a first pipe and second pipe, according to an embodiment.

FIG. 3 depicts an anchoring system 300 configured to anchor a plug in a first pipe 320 and second pipe 310 or wellbore, according to an embodiment. Elements depicted in system 300 may be described above, and for the sake of brevity a further description of these elements may be omitted.

As depicted in FIG. 3, a first pipe 320 may have a substantially uninform inner diameter, and second pipe 310 may have portions with different inner diameters. A distal end of second pipe 310 may have an inner diameter that is larger than an outer diameter of a proximal end of first pipe 320, such that an annulus may be formed between the distal end of second pipe 310 and proximal end of first pipe 320.

A packing 340 of stress relieving elements may be positioned within a container, such as a rubber bag 350. The rubber bag 350 containing the stress relieving elements may be configured to be positioned with the annulus between first pipe 320 and second pipe 310 and have a length that is at least as long as the effective screening length 360. In embodiments, the rubber bag 350 may be a non-permeable, elastic material that is configured to form a seal. When fluid flows through pipe 310 to pipe 320, or vice versa, rubber bag 350 may form a seal that is secured in place by the anchoring effect of packing 340, which may function as a seal and stop leakage even under fluid pressure. In embodiments, rubber bag 350 may be shaped and sized based on the geometry of the objects confining rubber bag 350. For example, as depicted in FIG. 3, rubber bag 350 may have a cross section that is substantially donut shaped with the diameters being substantially the same dimensions of annulus 330. In other embodiments, if a cross section of annulus 330 was square, triangular, etc. rubber bag 350 may have a cross section that is correspondingly shaped.

Figure 4:
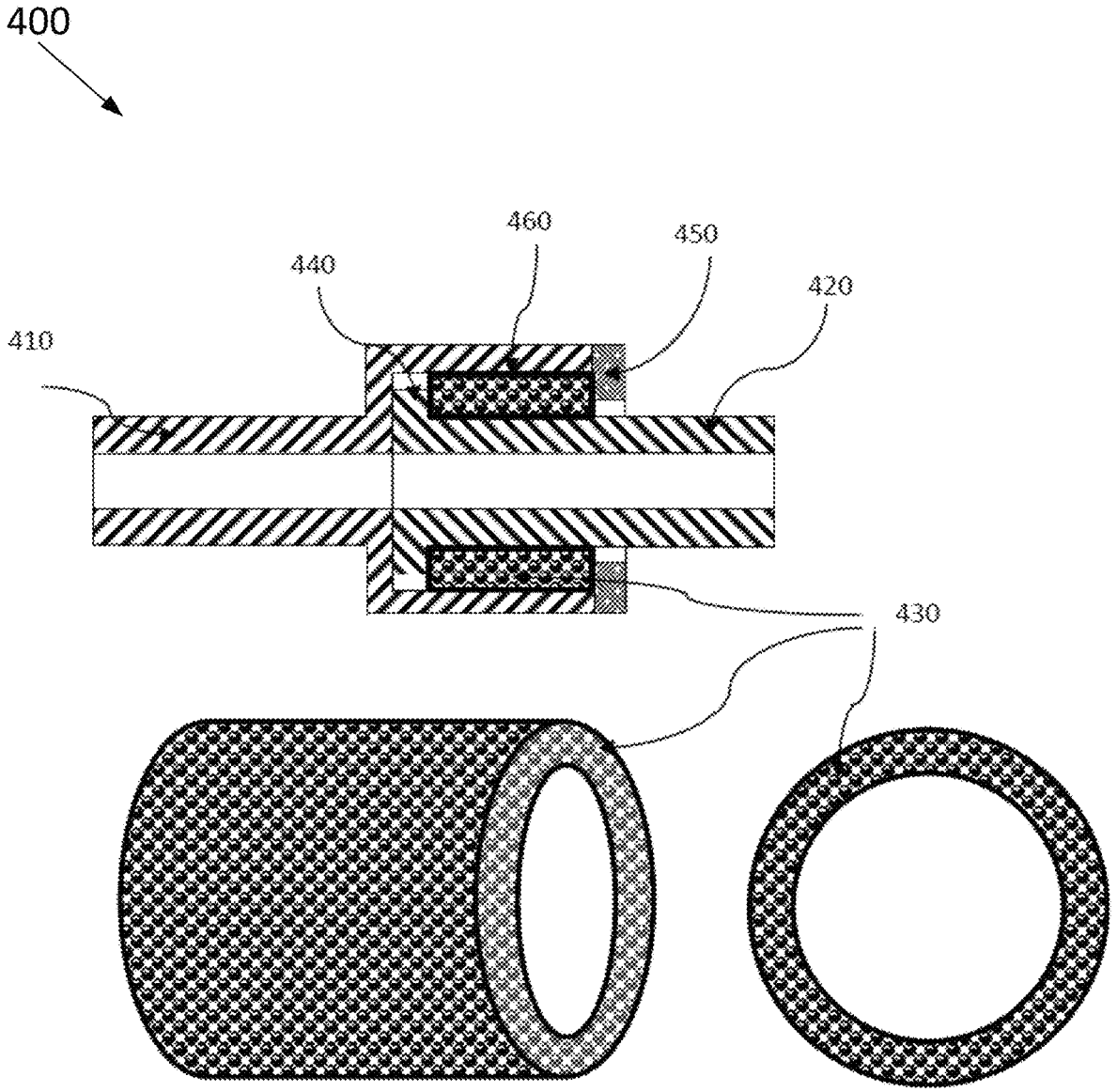
FIG. 4 depicts an anchoring system configured to anchor a plug in a first pipe and second pipe, according to an embodiment.

FIG. 4 depicts an anchoring system 400 configured to anchor a plug in a first pipe 410 and second pipe 420 or wellbore, according to an embodiment. Anchoring system 400 may also be configured to couple first pipe 410 and 420 by applying radial forces in opposite directions via the inner circumference and outer circumference of anchoring system 400. Elements depicted in system 400 may be described above, and for the sake of brevity a further description of these elements may be omitted.

In embodiments, when a seal packing element 430 comprised of stress relieving elements and a rubber container 460 is confined with profiles, stoppers, edges, etc. a length of the seal packing element 430 may be shorter than the effective screening length in the direction of the restricted movement of the seal packing element 430 as compared to situations where there are no stoppers. This is because that the stoppers, etc. may be viewed as a way to substantially increase the friction factor. When the friction factor increases, the effective screening length decreases.

As depicted in FIG. 4, seal packing element 430 of a donut-shape cross-section may be positioned within an annulus between first stopper 450 positioned on a proximal end of first pipe 410 and a second stopper 440 positioned on a distal end of second pipe 420. When the pressure within the annulus increases, the pressure may apply an axial force against seal packing element 430, which seal packing element 430 may translate the force to a radial or lateral direction against the walls of first pipe 410 and second pipe 420. More specifically, when being compressed, seal packing element 430 may apply a first radial force against first pipe 410 via the outer circumference of seal packing element 430, and a second radial force against second pipe 420 via the inner circumference of seal packing element 430. These radial forces may be simultaneously applied by seal packing element 430 receiving an axial force, wherein the simultaneously applied radial forces may couple first pipe 410 and second pipe 420 together.

In embodiments, seal packing element 430 may be installed within the annulus between pipes 410, 420 before pipes 410, 420 are installed downhole.

Figure 5:
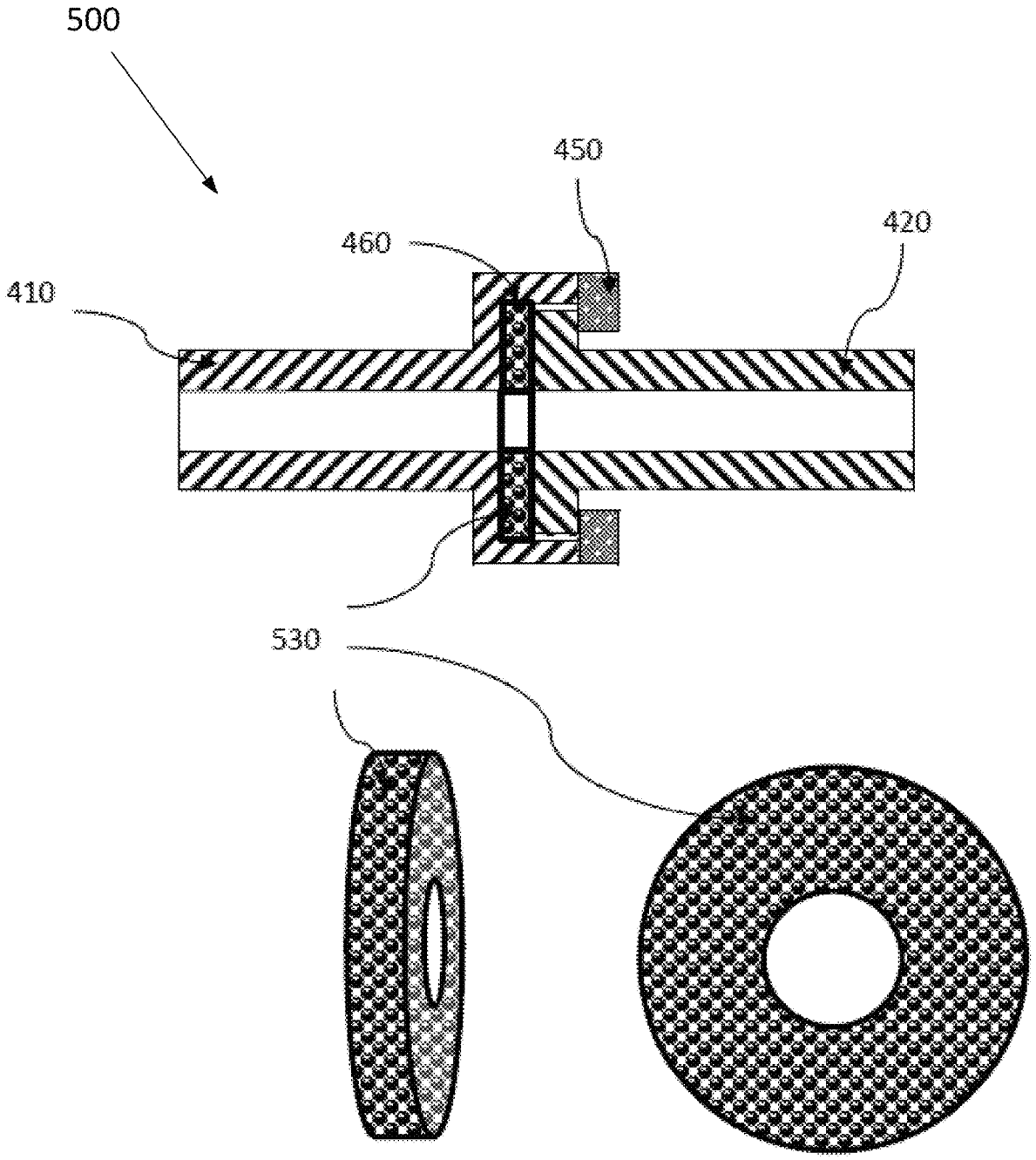
FIG. 5 depicts an anchoring system configured to anchor a plug in a first pipe and second pipe or wellbore, according to an embodiment.

FIG. 5 depicts an anchoring system 500 configured to anchor a plug in a first pipe 410 and second pipe 420 or wellbore, according to an embodiment. Elements depicted in system 500 may be described above, and for the sake of brevity a further description of these elements may be omitted.

As depicting in FIG. 5, sealing packing 530 comprised of stress relieving elements and a rubber container 460 may be installed between a first pipe 410 and a second pipe 420, wherein an inner diameter of seal packing element 530 is exposed to potential pressure through the pipe hollow chamber and an outer diameter of seal packing element 530 is positioned to an outer sidewall of pipe 410. Sealing packing 530 may be confined such that the length in the radial direction does not have to be longer than the regular effective screening length due to confinements. When pressure within the hollow chamber of the pipes 410, 420 increases, sealing packing 530 may be squeezed from the hollow chamber in a radial direction of the pipes. The stress relieving elements within the sealing packing 530 may then direct the force applied to the center hole of sealing packing 530 laterally towards the ending surfaces of pipes 410, 420 adjacent to the sealing packing 530. In this embodiment, the sealing packing 530 may have a longer radial distance between its inner rim and outer rim than its thickness. This longer radial distance is in the same direction of the effective screening length in this embodiment.

Figure 6:
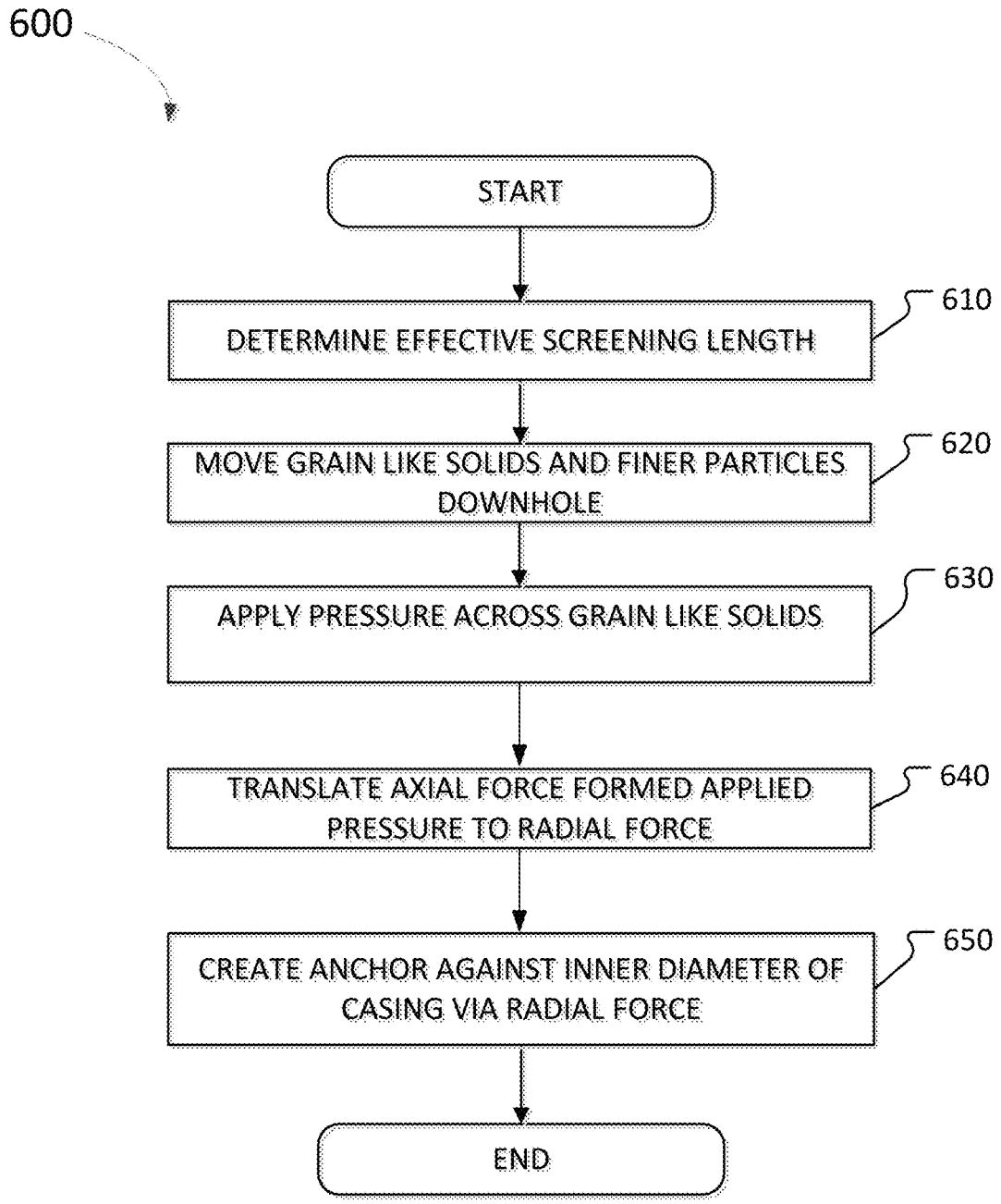
FIG. 6 depicts a method for anchoring a plug in a pipe, according to an embodiment.

FIG. 6 depicts a method 600 for anchoring a plug in a pipe, according to an embodiment. The operations of method 600 presented below are intended to be illustrative. In some embodiments, method 600 may be accomplished with one or more additional operations not described, and/or without one or more of the operations discussed. Additionally, the order in which the operations of method 600 are illustrated in FIG. 6 and described below is not intended to be limiting.

At operation 610, an effective screening length of the anchor may be determined. The effective screening length may be based on a plurality of different factors.

At operation 620, grain-like solids and finer particles may be pumped downhole. The finer particles may be configured to be positioned between the grain-like solids and a higher-pressure side of the system.

At operation 630, a pressure differential may be applied across the plug in an axial direction.

At operation 640, based on the pressure differential the grain-like solids may translate an axial force to a radial force against a wellbore wall. Wherein the applied radial forces may be applied via an inner circumference and an outer circumference of the plug.

At operation 650, the grain-like solids may compress, and bend, flex, mold, etc. to correspond to an annulus housing the grain-like solids. This compression may cause the radial forces of the grain-like solids to anchor the plug in place while dissipating the axial forces.

Although the present technology has been described in detail for the purpose of illustration based on what is currently considered to be the most practical and preferred implementations, it is to be understood that such detail is solely for that purpose and that the technology is not limited to the disclosed implementations, but, on the contrary, is intended to cover modifications and equivalent arrangements that are within the spirit and scope of the appended claims. For example, it is to be understood that the present technology contemplates that, to the extent possible, one or more features of any implementation may be combined with one or more features of any other implementation.

What is claimed is:

1. A system for anchoring a plug within a bore, the system comprising:

a plurality of stress relieving elements configured to be compressed responsive to receiving a first force to dissipate the first force via a second force, wherein the second force induces friction to anchor the plug in place, a total length of the plurality of stress relieving elements being at least as long as an effective screening length, wherein the effective screening length being based on a radius of the bore, friction factor between an inner wall of the bore and the plurality of stress relieving elements, and Janssen's coefficient;

a particle layer comprised of particles having a smaller diameter than each of the plurality of stress relieving elements;

an environmental layer formed of clay, the particle layer being positioned between the environmental layer and the plurality of stress relieving elements;

a higher pressure end of the bore; and a lower pressure end of the bore, wherein a proximal end of the stress relieving elements is positioned closer to the lower pressure end of the bore than the higher pressure end of the bore, the higher pressure end of the bore being positioned further downhole than the lower pressure end of the bore.

2. The system of claim 1, wherein the plurality of stress relieving elements are positioned within a rubber packing.

3. The system of claim 1, wherein each of the stress relieving elements comprise grain-like solids ranging in size from 500 microns to 2500 microns.

4. The system of claim 3, wherein the stress relieving elements are coupled together into a first portion and a second portion, wherein each of the stress relieving elements in the first portion are linked together and each of the stress relieving elements in the second portion are linked together.

5. The system of claim 1, wherein the stress relieving elements are permeable such that fluid may be communicated through the stress relieving elements, wherein the first force is an axial force and the second force is a radial or lateral force.

6. The system of claim 1, further comprising:

a first pipe;

and a second pipe, wherein the second force is configured to couple the first pipe and the second pipe.

7. The system of claim 6, wherein the first pipe has a first stopper and the second pipe has a second stopper.

8. A system for anchoring a plug within a bore, the system comprising:

a plurality of stress relieving elements configured to be compressed responsive to receiving a first force to dissipate the first force via a second force, wherein the second force induces friction to anchor the plug in place, a total length of the plurality of stress relieving elements being at least as long as an effective screening length, wherein the effective screening length being based on a radius of the bore, friction factor between an inner wall of the bore and the plurality of stress relieving elements, and Janssen's coefficient;

a first casing and a second casing; the first casing having a first outer diameter and the second casing having a second inner diameter, the second inner diameter being larger than the first outer diameter;

a cement layer having a proximal end positioned between the first casing and the second casing, each of the plurality of stress relieving elements being positioned between the first casing and the second casing, the first casing having a length that is at least as long as the effective screening length; and a particle layer comprised of particles having a smaller diameter than each of the plurality of stress relieving elements, the particle layer being positioned between the plurality of stress relieving elements and the cement layer.

9. The system of claim 8, wherein the plurality of stress relieving elements and the particle layers are pumped downhole through the first inner diameter before the cement is pumped downhole through the first inner diameter; wherein the plurality of stress relieving elements, particle layer, and the cement circulate towards a proximal end of the well out of the distal end of the first inner diameter.

10. A method for anchoring a plug within a bore, the system comprising:

determining an effective screening length for a plurality of stress relieving elements, the effective screening length being based on a radius of the bore, friction factor between an inner wall of the bore and the plurality of stress relieving elements, and Janssen's coefficient;

positioning the plurality of stress relieving elements within the bore with a length longer than the effective screening length;

applying a first force against the plurality of stress relieving elements;

compressing the plurality of stress relieving elements based on the first force;

dissipating and anchoring the plug in place within the bore based on a second force created when compressing the plurality of stress relieving elements;

forming a particle layer comprised of particles having a smaller diameter than each of the plurality of stress relieving elements;

forming an environmental layer of clay, the particle layer being positioned between the environmental layer and the plurality of stress relieving elements, wherein a proximal end of the stress relieving elements is positioned closer to a lower pressure end of the bore than a higher pressure end of the bore, the higher pressure end of the bore being positioned further downhole than the lower pressure end of the bore.

11. The method of claim 10, further comprising:

positioning the plurality of stress relieving elements within a rubber packing.

12. The method of claim 10, wherein each of the stress relieving elements comprise grain-like solids ranging in size from 500 microns to 2500 microns.

13. The system of claim 10, wherein the first force is an axial force and the second force is a radial or lateral force.

14. The method of claim 10, wherein the stress relieving elements are permeable such that fluid may be communicated through the stress relieving elements.

15. The method of claim 10, further comprising:

coupling a first pipe and a second pipe via the second force.

16. The method of claim 15, wherein the first pipe has a first stopper and the second pipe has a second stopper.

17. A method for anchoring a plug within a bore, the system comprising:

determining an effective screening length for a plurality of stress relieving elements, the effective screening length being based on a radius of the bore, friction factor between an inner wall of the bore and the plurality of stress relieving elements, and Janssen's coefficient;

positioning the plurality of stress relieving elements within the bore with a length longer than the effective screening length;

applying a first force against the plurality of stress relieving elements;

compressing the plurality of stress relieving elements based on the first force;

dissipating and anchoring the plug in place within the bore based on a second force created when compressing the plurality of stress relieving elements;

positioning a first casing and a second casing within the bore; the first casing having a first outer diameter and the second casing having a second inner diameter, the second inner diameter being larger than the first outer diameter;

forming a cement layer having a proximal end positioned between the first casing and the second casing, each of the plurality of stress relieving elements being positioned between the first casing and the second casing, the first casing having a length that is at least as long as the effective screening length; and forming a particle layer comprised of particles having a smaller diameter than each of the plurality of stress relieving elements, the particle layer being positioned between the plurality of stress relieving elements and the cement layer.

18. The method of claim 17, further comprising:

pumping the plurality of stress relieving elements and the particle layers downhole through the first inner diameter before the cement is pumped downhole through the first inner diameter; wherein the plurality of stress relieving elements, particle layer, and the cement circulate towards a proximal end of the well out of the distal end of the first inner diameter.

* * * * *